United States Patent [19]

Sturtz

[11] 4,171,815

[45] Oct. 23, 1979

[54] WORD FORMING GAME

[76] Inventor: George A. Sturtz, 7305 Oliver Smith, Des Moines, Iowa 50322

[21] Appl. No.: 913,198

[22] Filed: Jun. 6, 1978

[51] Int. Cl.[2] ..... A63F 3/00

[52] U.S. Cl. ..... 273/272; 273/284

[58] Field of Search ..... 35/35 H; 273/272, 284

[56] References Cited

U.S. PATENT DOCUMENTS

| | | | |
|---|---|---|---|
| 2,703,459 | 3/1955 | Paquette | 35/35 H |
| 3,149,842 | 9/1964 | Cirrincione | 273/284 X |
| 3,524,648 | 8/1970 | Nilan | 273/272 X |
| 3,565,439 | 2/1971 | Krouse | 273/272 |

*Primary Examiner*—Harland S. Skogquist

[57] ABSTRACT

A word forming game comprising a game board having three peripheral slides and an open side adapted to receive therebetween crossword puzzle inserts. The upper surface of two of the slides are numbered from thirteen to one. The crossword inserts have open squares to be filled in with play pieces marked with various letters to be inserted in the squares to provide definitions for words appearing in the puzzles. Also provided are score sheets to keep track of the players performance. The numbering on the slides also indicates points won by a player for placing the right letters in the correct squares in response to a puzzle question.

3 Claims, 5 Drawing Figures

WORD FORMING GAME

FIELD OF THE INVENTION

This invention relates generally to a word forming game of the crossword puzzle type employing game pieces.

DESCRIPTION OF THE PRIOR ART

The prior art, as exemplified by U.S. Pat. Nos. 3,326,557; 3,840,236; 3,877,703; 3,984,106; 3,503,612 and 3,524,648 is generally illustrative of the pertinent art but the aforementioned patents are non-applicable to the present invention. While the prior art expedients are generally acceptable for their intended purposes only, they have not proven entirely satisfactory in that they are either complex and expensive to manufacture. As a result of the shortcomings of the prior art, typified by the above, there has developed a substantial need for improvement in this field.

The principal object of this invention is to provide a device or article of this character which combines simplicity and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a word forming game comprising a game board having three peripheral slides and an open side adapted to receive therebetween crossword puzzle inserts. The upper surface of two of the slides are numbered from thirteen to one. The crossword inserts have open squares to be filled in with play pieces marked with various letters to be inserted in the squares to provide definitions for words appearing in the puzzles. Also provided are score sheets to keep track of the players performance. The numbering on the slides also indicates points won by a player for placing the right letters in the correct squares in response to a puzzle question.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
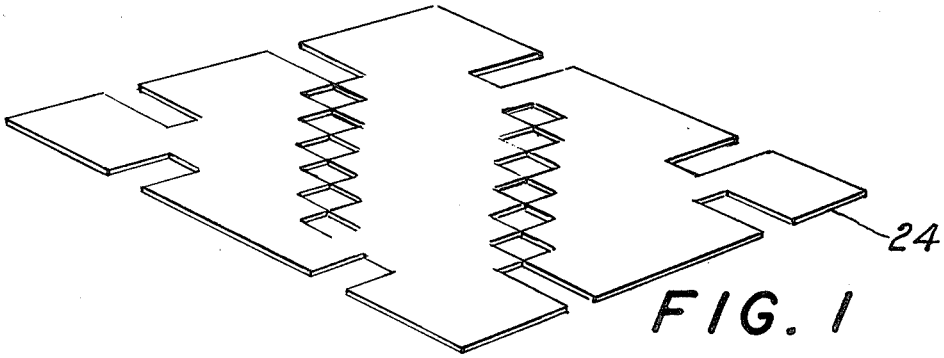
FIG. 1 is a perspective view showing a crossword puzzle insert.
Figure 2:
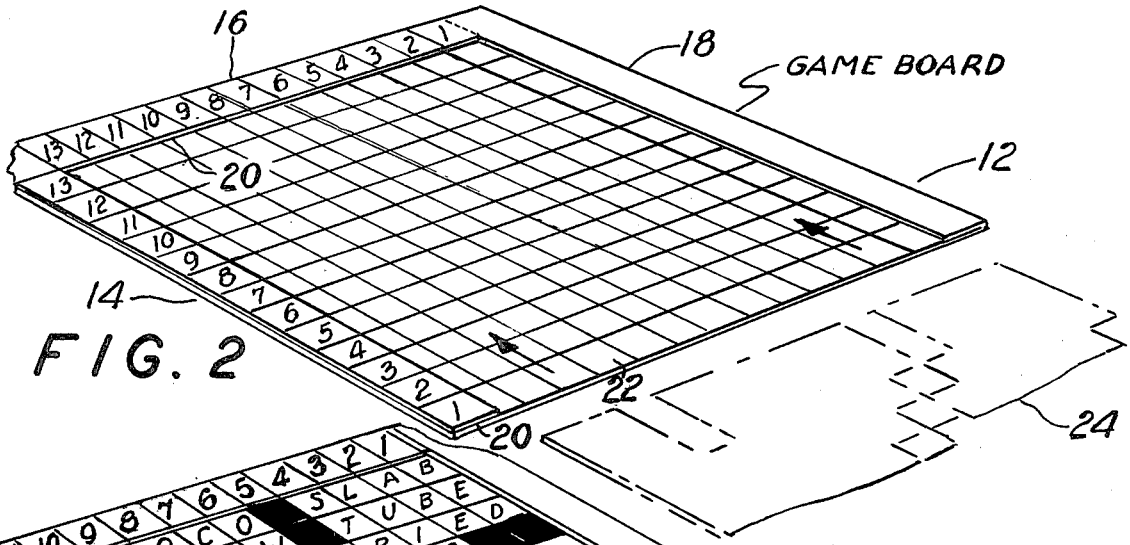
FIG. 2 is a perspective view of the game board in which the insert is received, the latter being shown in phantom line.

With reference to the drawing, there is shown and illustrated a word forming game constructed in accordance with the principles of the invention. The illustrated tangible embodiment of the invention includes a game board 12 made of suitable material such as cardboard or plastic with three raised sides 14, 16, 18. A space 20 is provided between the undersurface of the sides and the bottom 22 of the board 12 so as to form a slide or guide for holding in place the edges of crossword puzzle insert 24.

Figure 5:
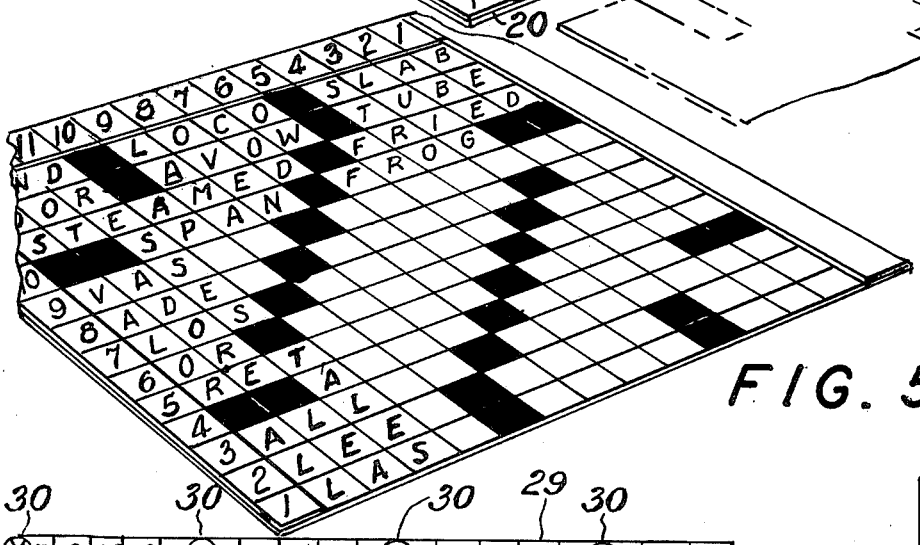
FIG. 5 is a perspective view of the board with an insert showing the game being played.

The present game is intended for use with a number of different inserts each having blocked out squares as shown in FIG. 5.

Board 22 has one-hundred-sixty-nine squares some of which are covered by the blocked out squares of the inserts.

Figure 3:
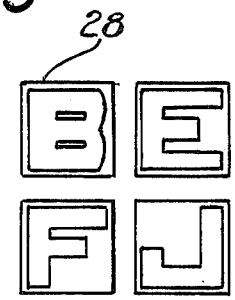
FIG. 3 is a top planar view of the play pieces.

The game includes one-hundred-sixty-eight tiles 28 each marked with a letter of the alphabet (FIG. 3). Each tile is of a size such as to fit in one of the open squares on board 22.

The following frequency distribution of the lettered tiles is used:

| | | | |
|---|---|---|---|
| A | - 17 | M and W | - 5 (Total) |
| B | - 2 | N and Z | - 11 (Total) |
| C and U | - 7 (Total) | O | - 10 |
| D | - 8 | P | - 5 |
| E | - 27 | Q | - 1 |
| F | - 1 | R | - 14 |
| G | - 3 | S | - 15 |
| H and I | - 12 (Total) | T | - 13 |
| J | - 1 | V | - 2 |
| K | - 1 | X | - 1 |
| L | - 10 | Y | - 2 |
| | | | 168 - TOTAL |

Also provided for the game is a holder for the tiles to be drawn. This can be a box of any size or shape. Each insert 24 is associated with a series of questions. FIG. 5 shows an example of an insert bearing a crossword puzzle which is partially solved as follows:

| Questions: | | ANSWERS |
|---|---|---|
| VERTICAL | | |
| Line 13: | Conjunction | AND |
| | Crazy (Slang) | LOCO |
| | Thick Slice | SLAB |
| 12: | Beetle | DOR |
| | Swear | AVOW |
| | Hollow Pipe | TUBE |
| 11: | Clams | STEAMED |
| | Cooked In Fat | FRIED |
| 10: | Reach | SPAN |
| | Amphibian | FROG |
| | (and on thru Line 1) | |
| HORIZONTAL | | |
| Line 13: | Classifieds | ADS |
| | Heroism | VALOR |
| | Everyone | ALL |
| 12: | Negative | NOT |
| | Love | ADORE |
| | Meadow | LEA |
| 11: | Gowns | DRESSES |
| | Stories | TALES |
| | (and on thru Line 1) | |

Figure 4:
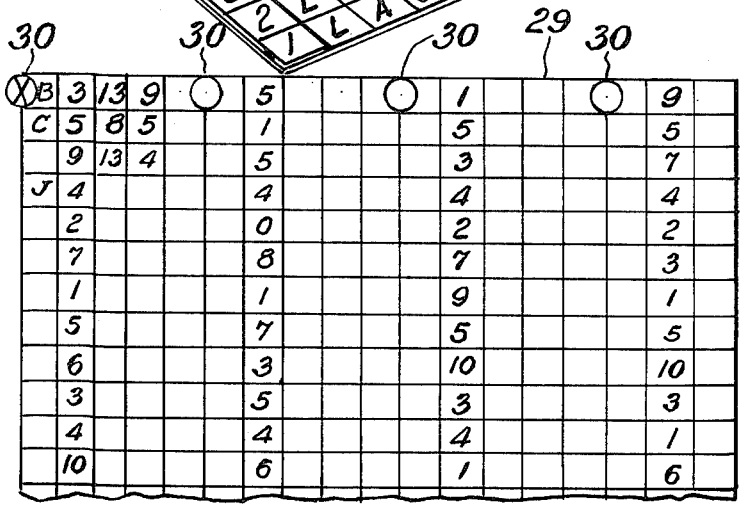
FIG. 4 is a top plan view of a score sheet for use with the game.

A score sheet 29 (FIG. 4) is provided which has a total of 816 bonus points. Four-hundred-eight points each, if played by two players, 272 points each, if played by three players, and 204 points each, if played by four players. There is a total of 168 tiles, the same as the number of spaces on the score sheet 29. Play is as follows:

Each player draws one tile. The one drawing nearest letter to "A" begins. His or her initial is inserted in the circles 30 above each column. Remaining players put their initials in the circles according to their positions at the table. The first player puts his tile in the square which will give him the greatest score. For instance, if he can place his tile in the vertical line 13 and the horizontal line 10, his score for the letter would be 13+10+bonus point (3)=26. Then play resumes to the right. Each player draws in order until all spaces on the score sheet are filled. If a player is unable to lay down a tile, it is put in the discard pile and only the bonus point is deducted. Circle the bonus point and deduct from total score.

The winner is not necessarily the one ending with the highest score. The one having the highest score in his column, whether or not he ends up with it, is the winner. If a player puts a tile in the wrong square, the total of his score, including his bonus point, is deducted from his high score at the end of the game. The reverse side of the score sheet may be used for calculations. Dictionaries are permissible.

In a modification, bonus points are not added to the score and are used only for subtracting points when a player cannot play his letter tile.

The game herein described combines the most interesting features of both Scrabble and crossword puzzles. The puzzles may be designed to be as difficult or as easy to solve as desired and the game may be packaged with a number of puzzle inserts of each type.

The use of the game hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can be applying current knowledge thereto readily adapt it for various applications without omitting certain features which can constitute essential characteristices of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. Apparatus for playing a word forming game comprising a game board having thirteen horizontal and thirteen vertical rows thereon defining an array of areas constituting playing piece locations; a plurality of playing pieces each provided with a letter of the alphabet; said pieces being distributed generally in accordance with the following frequency:

| | | | |
|---|---|---|---|
| A | 17 | M and W | 5 (Total) |
| B | 2 | N and Z | 11 (Total) |
| C and U | 7 (Total) | O | 10 |
| D | 8 | P | 5 |
| E | 27 | Q | 1 |
| F | 1 | R | 14 |
| G | 3 | S | 15 |
| H and I | 12 (Total) | T | 13 |
| J | 1 | V | 2 |
| K | 1 | X | 1 |
| L | 10 | Y | 2 |

a plurality of inserts adapted to fit over said game board and having certain open areas constituting play areas on which said playing pieces may be placed, puzzle questions associated with each insert and containing questions relating to said play areas to be answered by inserting certain of said pieces therein and score sheets for marking point score for each player.

2. The invention as recited in claim 1, wherein said board has three peripheral sides adapted to receive therein the edges of one of said inserts.

3. The invention as recited in claim 1, wherein horizontal and vertical rows are numbered in descending order from thirteen to one, said numbers indicating the point value of one said piece when same is inserted in a playing area corresponding to the intersection of one of said vertical rows with one of said horizontal rows.

* * * * *